US005370283A

United States Patent [19]

Nelson et al.

[11] Patent Number: 5,370,283

[45] Date of Patent: Dec. 6, 1994

[54] FLOW CONTROLLER FOR CARBONATED BEVERAGES

[76] Inventors: Peter K. Nelson, 16603 S. 12th Pl.; Brian D. Querin, 5152 E. Bannock St., both of Phoenix, Ariz. 85044

[21] Appl. No.: 231,792

[22] Filed: Apr. 25, 1994

[51] Int. Cl.[5] ..... B67D 5/60

[52] U.S. Cl. ..... 222/464; 137/170.1; 138/44; 138/177; 251/118

[58] Field of Search ..... 222/211, 382, 394, 464, 222/564; 137/590, 592, 170.1; 251/118; 138/108, 121, 177, 40, 44

[56] References Cited

U.S. PATENT DOCUMENTS

| | | | |
|---|---|---|---|
| 2,570,366 | 10/1951 | Mitchell | 222/464 X |
| 3,195,788 | 7/1965 | Wilson | 222/464 X |
| 3,307,751 | 3/1967 | Kraft | 222/464 |
| 3,469,745 | 9/1969 | Serio, Jr. et al. | 138/44 X |
| 3,854,498 | 12/1974 | Vecker | 251/118 X |
| 3,927,801 | 12/1975 | Martin et al. | 138/40 X |
| 4,031,913 | 6/1977 | Apellaniz | 138/44 X |
| 4,694,975 | 9/1987 | Hagan | 222/464 X |
| 4,708,176 | 11/1987 | Esser | 137/170.1 X |
| 4,861,165 | 8/1989 | Fredriksson et al. | 138/44 X |
| 5,022,565 | 6/1991 | Sturman et al. | 222/464 |

FOREIGN PATENT DOCUMENTS

| | | | |
|---|---|---|---|
| 2031526 | 4/1980 | United Kingdom | 222/464 |
| 2136057 | 9/1984 | United Kingdom | 222/464 |

*Primary Examiner*—Kevin P. Shaver

*Attorney, Agent, or Firm*—Cahill, Sutton & Thomas

[57] ABSTRACT

A beverage flow controller includes a tube having a first end and a second end, and a length between the first end and the second end including at least three constrictions. The constrictions have a center to center spacing of at least 4.5 times the inside diameter of the tube and have an inside diameter of 0.6 to 0.8 times the inside diameter of the tube. The plurality of constrictions controls the flow and provides a pressure gradient along the length of the tube.

14 Claims, 2 Drawing Sheets

FLOW CONTROLLER FOR CARBONATED BEVERAGES

BACKGROUND OF THE INVENTION

This invention relates to a flow controller for carbonated beverages and, in particular, to a flow controller for minimizing outgassing of the beverage as dispensed and of the beverage remaining in a bottle.

A carbonated beverage from a bottling company contains a significant amount of carbon dioxide dissolved in water, the two basic ingredients of all carbonated soft drinks. A large amount of carbon dioxide is dissolved in the soft drink to insure a minimal effervescence after the beverage is poured into a glass. Dispensing a carbonated beverage causes a significant loss of carbon dioxide which usually manifests itself as foaming. "Clear" or non-cola beverages foam less than cola beverages and root beer is formulated to sustain a foam.

Foaming and loss of carbonation are related as quantity and quality, not as alternative descriptions of the same problem. Foaming relates to how quickly a beverage can be delivered to a glass or other container. If a great deal of foam is produced, the volume of beverage delivered is relatively low and it takes a long time to fill a glass because of the time it takes for the foam to dissipate. An alternative is to fill the glass while letting the foam spill into a drain, wasting the beverage.

Loss of carbonation occurs in the beverage dispensed and in the beverage remaining in the bottle. In either case, the beverage goes "flat" and the taste is less appealing to most people. Actually, the reduced effervescence weakens the aroma of the beverage, which is interpreted as a loss of taste or flavor. Regardless of what is actually happening, the beverage industry relies on what consumers perceive and the perception is that the beverage has lost its flavor.

With the popularity of the two liter "PET" (polyethyleneterephthalate) bottle, it is extremely important that the beverage in a partially emptied bottle not go flat. The bottling industry addresses the problem by dissolving a large quantity of carbon dioxide in the beverage, creating an unstable, super-saturated solution.

Opening a bottle and pouring a drink reduces the effervescence of the beverage in two ways. Opening or unsealing the bottle releases the $CO_2$ which has escaped from the beverage during storage. The act of pouring disturbs the beverage, causing the release of the dissolved carbon dioxide from both the beverage being dispensed and the beverage remaining in bottle. Once carbon dioxide is released, it does not re-dissolve. By dissolving a large amount of carbon dioxide in the beverage, the bottlers are attempting to assure that some will remain dissolved when the last of the bottle is poured.

The prior art has addressed the problem of loss of carbonation with a variety of dispensers. U.S. Pat. No. 3,976,221 (Martin et al.) discloses a dispenser which uses a $CO_2$ cartridge but adds a foam inhibiting portion including a passageway having two constrictions in the form of Teflon balls of different sizes in the passageway. U.S. Pat. No. 5,022,565 (Sturman et al.) discloses a dispenser which uses a $CO_2$ cartridge and a pressure regulator to maintain pressure within a bottle and to prevent effervescence within the bottle. The Sturman et al. patent also discloses that "the use of some form of flow restrictor . . . will only aggravate the foaming problem." Neither patent addresses the problem of providing an optimum flow of beverage to minimize the time for filling a glass or other container.

As used herein, "bottle" designates the source of a beverage, whether the source is actually a bottle or is a can, keg, or some other container. "Bottle" does not imply a particular material since carbonated beverages come in containers made from metal, plastic, glass, or other materials.

Corrugated tubes for beverages are known in the art, e.g. a straw having a corrugated section, but only for flexibility, not for controlling the flow of carbonated beverage.

In view of the foregoing, it is therefore an object of the invention to provide a flow controller for carbonated beverages which delivers a large volume of beverage with a minimal amount of foaming.

Another object of the invention is to provide a flow controller for carbonated beverages which causes minimal outgassing of the dispensed beverage.

A further object of the invention to provide a flow controller for carbonated beverages which quickly delivers a predetermined volume of beverage within a minimal foaming.

Another object of the invention is to provide a flow controller for carbonated beverages which can be added to existing dispensers.

A further object of the invention is to provide a dispenser which is sealed to a bottle and dispenses carbonated beverage by means of accumulated pressure in the bottle.

SUMMARY OF THE INVENTION

The foregoing objects are achieved in the invention in which a flow controller includes a tube having a first end and a second end, and a length between said first end and said second end including at least five constrictions in which the cross-sectional area of the tube is reduced. In one embodiment of the invention, the constrictions are sections of tube having a reduced diameter, wherein the constrictions have a center to center spacing of at least 4.5 times the inside diameter of the tube and have an inside diameter of 0.6 to 0.8 times the inside diameter of the tube.

In an alternative embodiment of the invention, the tube includes an insert having portions of larger or smaller diameter to reduce the cross-sectional area of the tube. The larger outside diameter of the insert is less than the inside diameter of the tube and the insert is held in place by longitudinal webs engaging the inside of the tube. The cross-sectional area of the flow space (between the larger diameter portion of the insert and the inner wall of the tube) is 0.36 to 0.64 times the cross-sectional area of the flow space at the smaller diameter portion of the insert.

The plurality of constrictions controls the flow and provides a pressure gradient along the length of the tube for reducing foaming while providing a high volume of beverage.

BRIEF DESCRIPTION OF THE DRAWINGS

A more complete understanding of the invention can be obtained by considering the following detailed description in conjunction with the accompanying drawings, in which.

DETAILED DESCRIPTION OF THE INVENTION

Figures 1, 2, 3, 7:
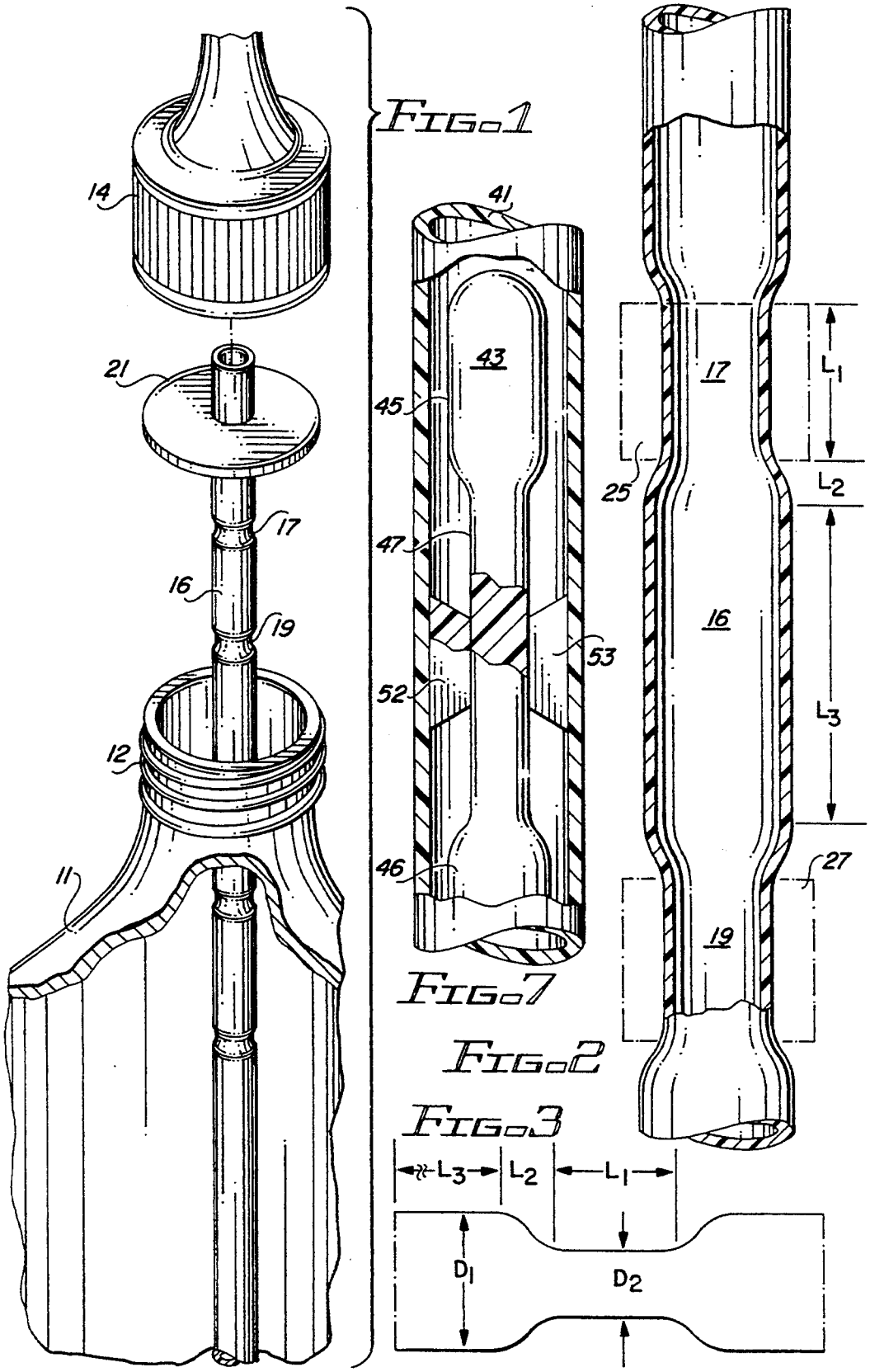
FIG. 1 illustrates a bottle including a flow controller constructed in accordance with a preferred embodiment of the invention.
FIG. 2 is a detail of a section of tubing having constrictions in accordance with the invention.
FIG. 3 is a diagram of the geometry of a flow control constructed in accordance with the invention.
FIG. 7 illustrates a flow control constructed in accordance with an alternative embodiment of the invention.

In FIG. 1, bottle 11 includes threaded neck 12 for engaging cap 14 to close the bottle. Cap 14 includes a suitable valve and spout (not shown) for dispensing the beverage from bottle 11. Interposed between cap 14 and the beverage within bottle 11 is a flow controller for conveying the beverage to cap 14. The flow controller includes tube 16 and a plurality of constrictions such as constrictions 17 and 19. Tube 16 is held in place by gasket 21 which seals the bottle to retain the gas bubbling out of the beverage. As the gas escapes, pressure builds up within the sealed bottle and this pressure is used to propel the beverage through the flow controller and from the bottle when the valve (not shown) in cap 14 is opened.

Tube 16 is illustrated in greater detail in FIG. 2 which illustrates a flow control section constructed in accordance with the invention. Tube 16 can be made from any rigid or flexible material in which the constrictions are permanently formed into the tubing or are temporarily produced by external rings, such as rings 25 and 27, held in place by friction or a suitable adhesive. In a preferred embodiment of the invention, tubing 16 is made from a thermosetting plastic in which the constrictions are permanently formed in the tubing.

A flow control section includes two constrictions separated by a predetermined distance. In addition to the diameter of the constriction, the length of the constriction along the longitudinal axis of the tube contributes to the control of the flow of beverage through the tube. In FIG. 2, the length of the constriction is denoted $L_1$, the transition from the constriction to the full diameter of the tube is denoted by length $L_2$, and the distance between constrictions is denoted $L_3$.

There are two aspects to the problem of dispensing carbonated beverages, one is quantity and the other is quality. Pouring from an opened bottle obviously provides the maximum quantity of beverage but the turbulent and chaotic flow of the beverage, and the velocity with which it strikes the glass or other container, can cause excessive foaming and outgassing. Pouring very slowly increases the time it takes to fill a glass and does not overcome the problem of releasing accumulated $CO_2$ each time the bottle is opened.

It has been found that simply providing a tube of a particular diameter does not permit one to dispense the maximum amount of beverage in the least amount of time with minimal outgassing. In accordance with the invention, a plurality of constrictions are provided in a tube to control the flow and to control the pressure drop or pressure gradient between the pressure within a bottle and the pressure outside the bottle, i.e. ambient or atmospheric pressure. The particular geometry described herein relates to dispensing carbonated beverages having a temperature of 30° to 50° Fahrenheit and a pressure in the bottle of approximately 10–40 pounds per square inch psi) above ambient pressure. Pressure and temperature are related but not linearly. The temperature range given is the typical serving temperature for beverages. At higher temperatures, the outgassing is more severe and the pressure is higher. As more fully described herein, the pressure affects the preferred number of constrictions.

FIG. 3 illustrates the geometry of a constriction in accordance with the invention. The number of constrictions and the geometry of the constrictions controls the flow of beverage. It is believed that the invention works by distributing the pressure gradient (between the bottle and ambient or atmospheric pressure) over the length of the tube (i.e. over the distance between the beginning of the first constriction and the end of the last constriction), thereby preventing a flow sufficiently turbulent to cause significant outgassing of the beverage. At the same time, the quantity of beverage flowing through the tube is as high as possible but at a sufficiently low velocity that the beverage does not outgas significantly upon striking a glass.

The geometry of the constriction illustrated in FIG. 3 is summarized in the following table in which $D_1$ is the inside diameter of the tube, $D_2$ is the inside diameter of the constriction, and $L_1$, $L_2$, and $L_3$ are as defined above.

| |
|---|
| $0.2'' \geqq D_1 \geqq 0.1''$ |
| $0.8 \times D_1 \geqq D_2 \geqq 0.6 \times D_1$ |
| $2 \times D_1 \geqq L_1 \geqq D_1$ |
| $1.5 \times D_1 \geqq L_2 \geqq 0.5 \times D_1$ |
| $8 \times D_1 \geqq L_3 \geqq 3 \times D_1$ |

The constrictions have a center to center spacing of L1+L2+L3 or from 4.5 to 11.5 times the inside diameter of the tube.

Figure 4:
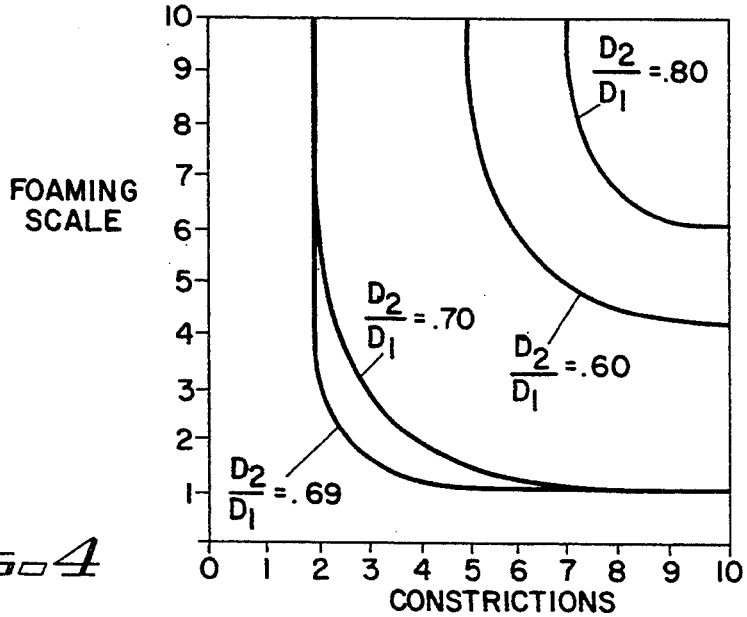
FIG. 4 is a chart comparing the amount of foaming of a typical cola with the number of constrictions for different ratios of constriction diameter to tube diameter.

FIG. 4 illustrates the relationship between the number of flow sections and the amount of foaming. It has been found that a minimum number of flow sections is required and that the maximum number of flow sections is determined by the size of the pressure gradient. A higher number of flow sections is preferred for higher pressure gradients to keep the pressure drop per flow section approximately one to four psi.

As illustrated in FIG. 4, two constrictions and the distance between them, i.e. one flow section, is not sufficient to reduce excessive foaming, indicated on abscissa 31 in FIG. 4. The scale on abscissa 31 is a subjective rating of foaming. The amount of foaming depends upon the kind of beverage being tested. As described above, clear beverages have the least foaming while colas and root beer has the greatest foaming. For a dark cola, it has been found that five to eight constrictions (four to seven flow sections) reduces the foaming to an acceptable level while providing the maximum amount of beverage per unit time. For colas stored at 15–31 psi, eight to twelve restrictions are preferred.

FIG. 4 also illustrates the effect of the ratio of the inside diameter of the constriction to the inside diameter of the tube on foaming. It has been found that a ratio of 0.69 produces the greatest effect within a range of 0.6 to 0.8.

Figure 5:
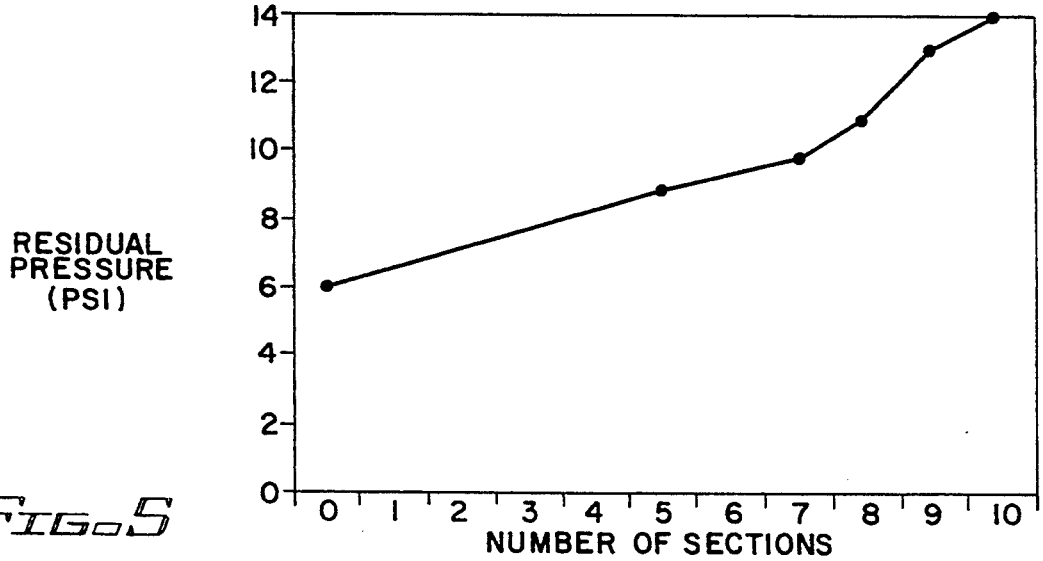
FIG. 5 is a chart comparing the residual pressure in dispensed beverage with the number of flow sections.

FIG. 5 illustrates the residual pressure of $CO_2$ in dispensed beverage compared to the number of flow sections used to dispense the beverage. The residual pressure of $CO_2$ in the dispensed beverage was determined by dispensing eight ounces of beverage into a sample bottle and then immediately sealing the sample bottle. The sample bottle was then shaken vigorously to drive the residual $CO_2$ out of the beverage. The bottle was then immersed in a 40° F. bath for a minimum of one minute and the pressure was measured by a pressure gauge attached to the sample bottle. The higher the pressure, the greater the effervescence level of the dispensed beverage. If the pressure was seven psi or less, the dispensed beverage was considered "flat."

The test was repeated for flow controllers having different numbers of constrictions. As shown in FIG. 5, the residual pressure, which indicates the amount of carbonation remaining in the beverage, increased significantly with five to ten flow control sections.

Figure 6:
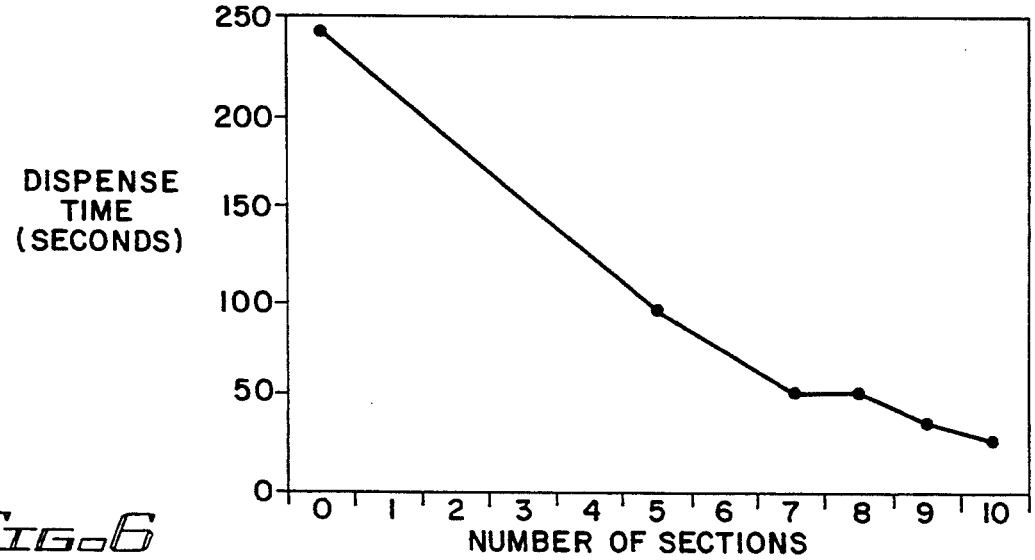
FIG. 6 is a chart comparing the time to dispense a predetermined amount of beverage with the number of flow sections.

As part of the test, the time required for the liquid (not liquid plus foam) to reach the eight ounce mark was measured, As shown in FIG. 6, the time to dispense eight ounces of beverage decreases significantly using a flow controller constructed in accordance with the invention. Particularly with five to ten flow control sections, the time to fill an eight ounce glass decreases from approximately two hundred forty seconds to approximately eighteen seconds. These times are for a single tube having a plurality of flow control sections. Obviously, the times can be further reduced by using two or more tubes in parallel, e.g. two tubes would double the flow.

A flow controller constructed in accordance with the invention divides the pressure gradient between the bottle and atmospheric or ambient pressure to reduce the turbulence of the flow and the consequent outgassing. The transition ($L_2$) from the full diameter of the tube to the constriction is believed to reduce eddy currents which could cause outgassing, greatly changing the local pressure in the tube.

FIG. 7 illustrates a flow controller in which the tube has a uniform inside diameter and contains an insert for changing the flow space, i.e. the cross-sectional area through which the beverage can flow. In FIG. 7, the flow controller includes tube 41 and insert 43. Insert 43 has a plurality of sections, such as sections 45 and 46, having a larger diameter and sections having a smaller diameter, such as section 47, connected by smooth transitions. Insert 43 can be held in place at each end or by longitudinal webs along the length of the insert, such as webs 52 and 53. Webs 52 and 53 can extend the length of insert 43 or can be segmented as shown in FIG. 7.

The dimensions $L_1$, $L_2$, and $L_3$, described above, apply to insert 43. The ratios described above in terms of diameter apply to insert 43 but are expressed in terms of cross-sectional area. Defining the flow space around section 47 as $A_1$ and the constriction or flow space around section 45 as $A_2$, then the following table shows the relationship of the areas.

| |
|---|
| $0.031\ \text{in.}^2 \geqq A_1 \geqq 0.008\ \text{in.}^2$ |
| $0.64\ A_1 \geqq A_2 \geqq 0.36\ A_1$ |
| $0.4'' \geqq L_1 \geqq 0.1''$ |
| $0.3'' \geqq L_2 \geqq 0.05''$ |
| $1.6'' \geqq L_3 \geqq 0.3''$ |

The invention thus provides a flow controller for carbonated beverages which provides a large flow of beverage with a minimum amount of foaming and a maximum amount of effervescence in the dispensed beverage. The flow controller can be added to existing dispensers and made an integral part of new dispensers. The flow controller is sealed to the bottle to prevent loss of escaped gas and to retain as much gas as possible in the beverage remaining in the bottle.

Having thus described the invention, it will be apparent to those of skill in the art that various modifications can be made within the scope of the invention. For example, the flow controller can include a manual pump or a $CO_2$ cartridge for propelling the beverage from bottle 11. The particular geometry will change for other applications of the invention, e.g. for filling the bottles at a bottling plant in which the beverage is at a temperature less than 38° Fahrenheit in order to increase the solubility of the $CO_2$. In particular, the inside diameter of the tube can be larger for beverages at lower temperatures. The ratios remain approximately the same. One or more tubes constructed in accordance with the invention can be used for conveying carbonated beverages from any source at one pressure to a destination at another pressure, e.g. for filling or dispensing from beer kegs. While illustrated as a tube having a circular cross-section, the tube can have any desired cross-section although curves are preferred to figures having corners. The maximum separation of the constrictions ($L_3$) is largely dependent upon the overall available length for the flow controller. For a two liter bottle, the overall length available for the flow controller is less than twelve inches. Connecting a beer keg to a tap with a flow controller constructed in accordance with the invention, $L_3$ can be larger than the maximum dimension given above. Beyond the minimum separation described above, one can separate the constrictions by any desired amount, although this might make the flow controller unnecessarily long.

What is claimed is:

1. A dispenser for a carbonated beverage, said dispenser comprising:

a bottle for containing said beverage;

a cap attached to said bottle for sealing said bottle, said cap containing a valve for controlling the flow of beverage from said bottle;

a tube having a first end connected to said cap and a second end in said bottle for conveying said beverage to said cap, said tube having an inside diameter and a length between said first end and said second end including at least three constrictions, wherein said constrictions have a center to center spacing of from 4.5 to 11.5 times the inside diameter of said tube.

2. The dispenser as set forth in claim 1 wherein said constrictions have an inside diameter of 0.6 to 0.8 times the inside diameter of said tube.

3. The dispenser as set forth in claim 2 wherein said constrictions have an inside diameter of 0.69 times the inside diameter of said tube.

4. The dispenser as set forth in claim 2 wherein said tube includes at least five to ten constrictions.

5. The dispenser as set forth in claim 1 wherein said tube includes at least five to ten constrictions.

6. The dispenser as set forth in claim 1 wherein said constrictions have a length of 1 to 2 times the inside diameter of said tube.

7. The dispenser as set forth in claim 1 wherein said tube has an inside diameter $D_1$, each constriction has an inside diameter $D_2$ and a length $L_1$, a distance between constrictions $L_3$, not including a transition length $L_2$; wherein $$0.8\times D_1 \geqq D_2 \geqq 0.6\times D_1$$

$$2\times D_1 \geqq L_1 \geqq D_1$$

$$1.5\times D_1 \geqq L_2 \geqq 0.5\times D_1$$

$$8\times D_1 \geqq L_3 \geqq 3\times D_1.$$

8. A flow controller for conveying carbonated beverage from a source at a first pressure to a destination at a second pressure, said flow controller comprising:

a tube having a first end, a second end, and a length between said first end and said second end, said tube having an inside diameter and at least three constrictions along said length, wherein said constrictions have a center to center spacing of from 4.5 to 11.5 times the inside diameter of said tube.

9. The flow controller as set forth in claim 8 wherein said constrictions have an inside diameter of 0.6 to 0.8 times the inside diameter of said tube.

10. The flow controller as set forth in claim 9 wherein said tube includes at least five to ten constrictions.

11. The flow controller as set forth in claim 8 wherein said tube includes at least five to ten constrictions.

12. The flow controller as set forth in claim 8 wherein said constrictions have a length of 1 to 2 times the inside diameter of said tube.

13. The flow controller as set forth in claim 8 wherein said tube has an inside diameter $D_1$, each constriction has an inside diameter $D_2$ and a length $L_1$, a distance between constrictions $L_3$, not including a transition length $L_2$; wherein $$0.8\times D_1 \geqq D_2 \geqq 0.6\times D_1$$

$$2\times D_1 \geqq L_1 \geqq D_1$$

$$1.5\times D_1 \geqq L_2 \geqq 0.5\times D_1$$

$$8\times D_1 \geqq L_3 \geqq 3\times D_1.$$

14. A dispenser for a carbonated beverage, said dispenser comprising:

a bottle for containing said beverage;

a cap attached to said bottle for sealing said bottle, said cap containing a valve for controlling the flow of beverage from said bottle;

a tube having a first end connected to said cap and a second end in said bottle for conveying said beverage to said cap, said tube having an inside diameter and a length between said first end and said second end; and an insert in said tube, said insert having a plurality of first sections having a first diameter separated by a plurality of sections having a second diameter, wherein said first diameter is greater than said second diameter and said sections form at least three constrictions along said length and the flow space through each constriction is from 0.36 to 0.64 times the flow space between constrictions.

* * * * *